US006286689B1

(12) United States Patent
Sherwood et al.

(10) Patent No.: US 6,286,689 B1
(45) Date of Patent: Sep. 11, 2001

(54) FLOORING SAMPLE HOLDER

(75) Inventors: Richard A. Sherwood, Southlake; Chris Roberson, North Richland Hills; Clay Bibb, Granbury; Tom May, Fort Worth, all of TX (US)

(73) Assignee: Miramar Designs, Inc., Fort Worth, TX (US)

( * ) Notice: Subject to any disclaimer, the term of this patent is extended or adjusted under 35 U.S.C. 154(b) by 0 days.

(21) Appl. No.: 09/188,757

(22) Filed: Nov. 9, 1998

(51) Int. Cl.[7] ..... A47F 7/16

(52) U.S. Cl. ..... 211/45; 211/195

(58) Field of Search ..... 211/45, 46, 40, 211/41.12, 55, 195, 204; D6/709; D21/392; 312/264, 265.2, 265.3, 265.5, 265.6, 183; 108/181, 187, 153.1

(56) References Cited

U.S. PATENT DOCUMENTS

| | | | | |
|---|---|---|---|---|
| 945,985 | * | 1/1910 | Schroeder | 211/45 |
| 2,839,200 | * | 6/1958 | Easterwood | 211/45 |
| 3,315,814 | * | 4/1967 | Korsen | 211/50 X |
| 3,798,423 | * | 3/1974 | Mindick | 211/45 X |
| 4,093,076 | * | 6/1978 | Newton | 211/74 |
| 4,712,679 | * | 12/1987 | Lowe | 211/40 X |
| 5,035,332 | * | 7/1991 | Stravitz | 211/40 |
| 5,103,986 | * | 4/1992 | Marlowe | 211/41.12 |
| 5,810,176 | * | 9/1998 | Stravitz | 211/45 X |
| 5,819,922 | * | 10/1998 | Martin, Jr. | 206/214 |
| 5,934,463 | * | 8/1999 | Yu | 211/41.12 X |

* cited by examiner

*Primary Examiner*—Daniel P. Stodola
*Assistant Examiner*—Erica B. Harris
(74) *Attorney, Agent, or Firm*—Arthur F Zobal

(57) ABSTRACT

The apparatus includes two side members each having a plurality of spaced apart slats formed on its inner side with adjacent slats forming a slot. The side members have upper edges which slant upward and rearward from the upper ends of their front edges. Each rearward of an adjacent slat has its top and bottom edges located at a level above the top and bottom edges respectively of the adjacent slat. The side members are supported such that their slats face each other and are spaced from each other to form a flooring sample receiving space. A floor is coupled between the two side members at the bottom edges of the slats. Each slot of one side member is aligned with a slot of the other side member to form a plurality of pairs of slots with each pair of slots and the floor being adapted to support a flooring sample. Each of the side members and its slats are formed as an integral member molded from plastic material. The floor is formed of plastic and has an upper side with a plurality of spaced apart ridges for engaging the edges of the samples. A plurality of sockets are molded to each side member for receiving a plurality of connecting members for connecting the two side members together and for supporting the floor.

9 Claims, 10 Drawing Sheets

FLOORING SAMPLE HOLDER

BACKGROUND OF THE INVENTION

1. Field of the Invention

The invention relates to a holder for holding flooring samples such as carpet samples for display.

2. Description of the Prior Art

The following U.S. Patents disclose holders for holding flooring samples: U.S. Pat. Nos. 5,447,242; 3,428,186; 1,360,548; 786,176; D 335,781; D 318,192; D 303,461; D 303,460; and D 161,815.

SUMMARY OF THE INVENTION

It is an object of the invention to provide a unique and easy to manufacture apparatus for holding flooring samples for display purposes.

The apparatus comprises two side members each having a plurality of spaced apart slats formed on its inner side with adjacent slats forming a slot. The side members have front and rear edges and upper edges, which slant upward and rearward from the upper ends of the front edges. Each slat rearward of an adjacent slat has its top and bottom edges located at a level above the top and bottom edges respectively of the adjacent slat. The side members are supported such that their slats face each other and are spaced from each other to form a flooring sample receiving space. A floor is coupled between the two side members at the bottom edges of the slats. Each slot of one side member is aligned with a slot of the other side member to form a plurality of pairs of slots with each pair of slots and the floor being adapted to support a flooring sample.

In a further aspect, each of the side members and its slats comprise an integral member molded from plastic material.

In another aspect, the floor comprises an upper side having a plurality of spaced apart ridges each for engaging an edge of a flooring sample.

In still another aspect, the apparatus comprises a plurality of sockets molded to each side member for receiving a plurality of connecting members for connecting the two side members together and for supporting the floor.

DESCRIPTION OF THE PREFERRED EMBODIMENTS

Figure 4:
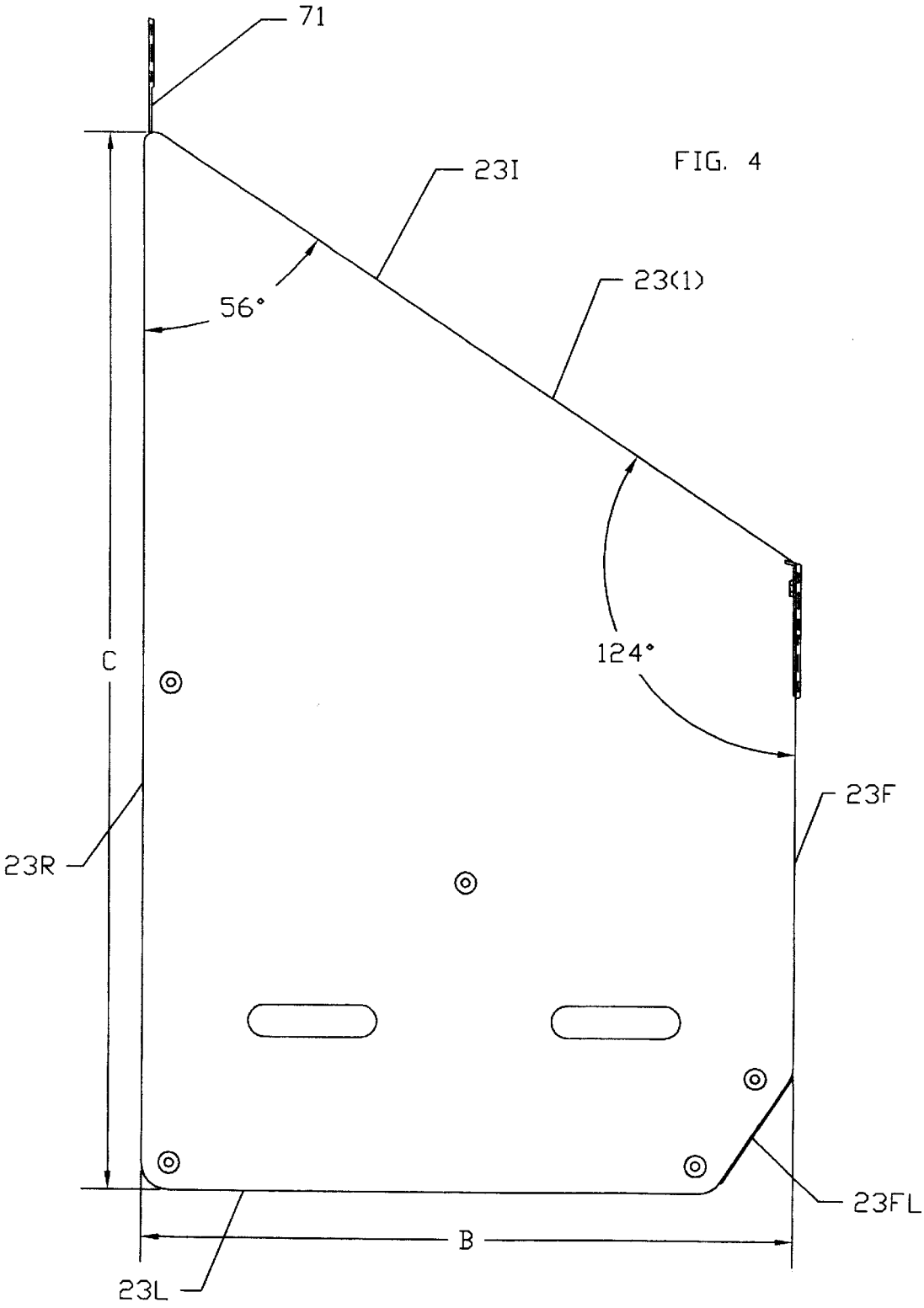
FIG. 4 is a left side plan view of the holder of the FIG. 1.
Figure 5:
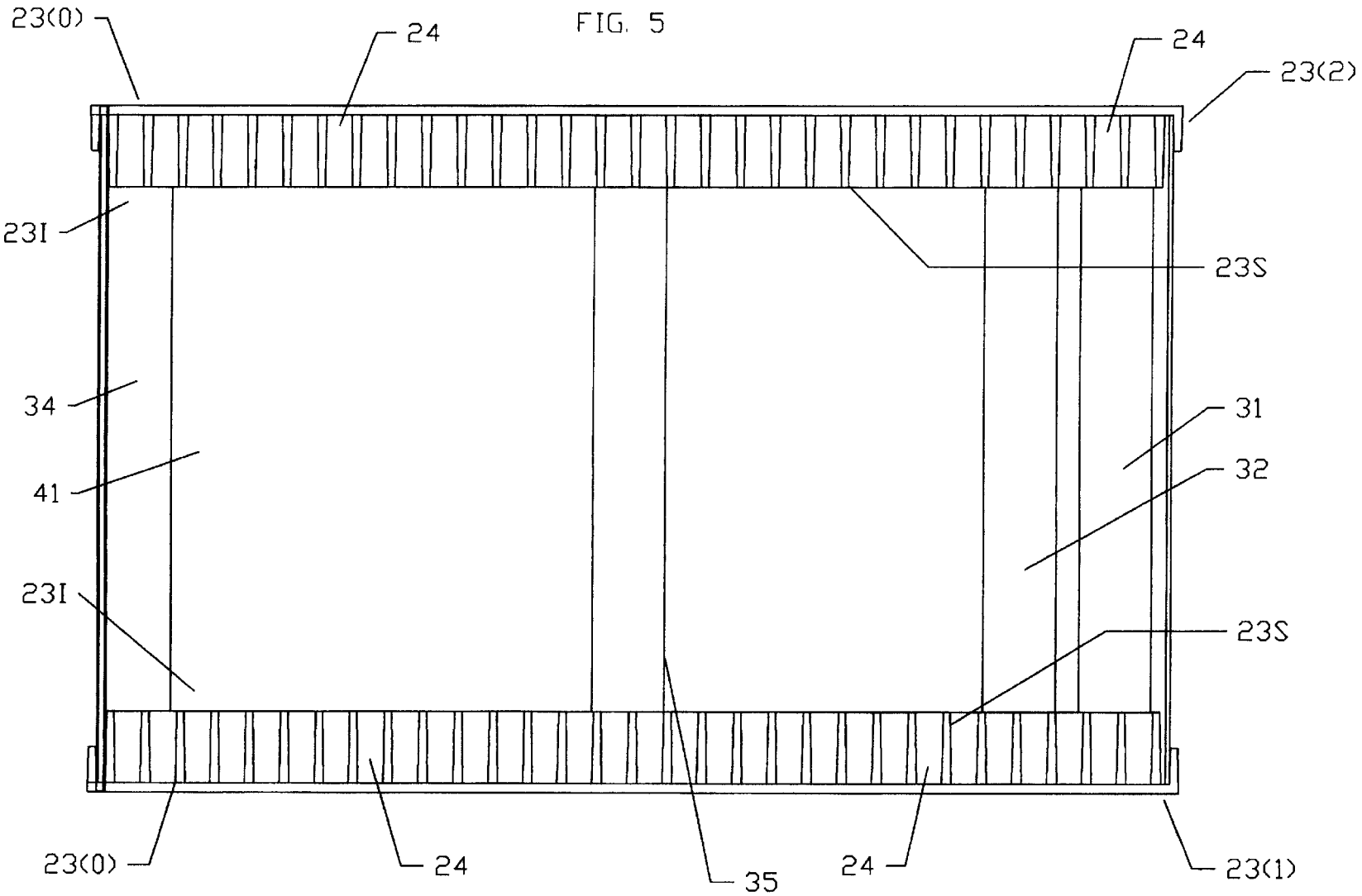
FIG. 5 is a top plan view of the holder of FIG. 1 without the floor panels.
Figure 7:
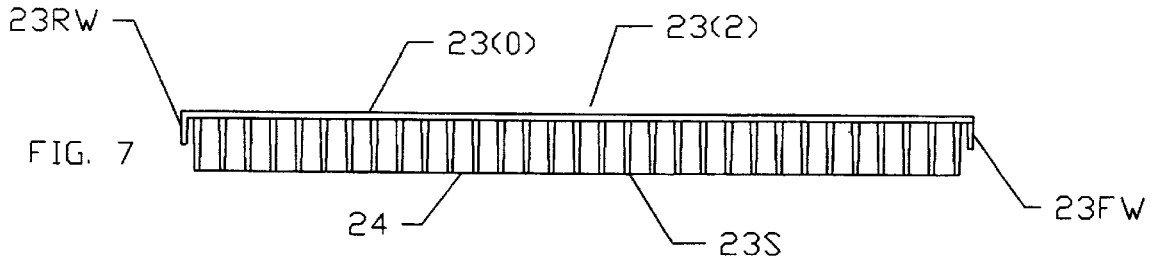
FIG. 7 is a top plan view of FIG. 6.
Figure 6:
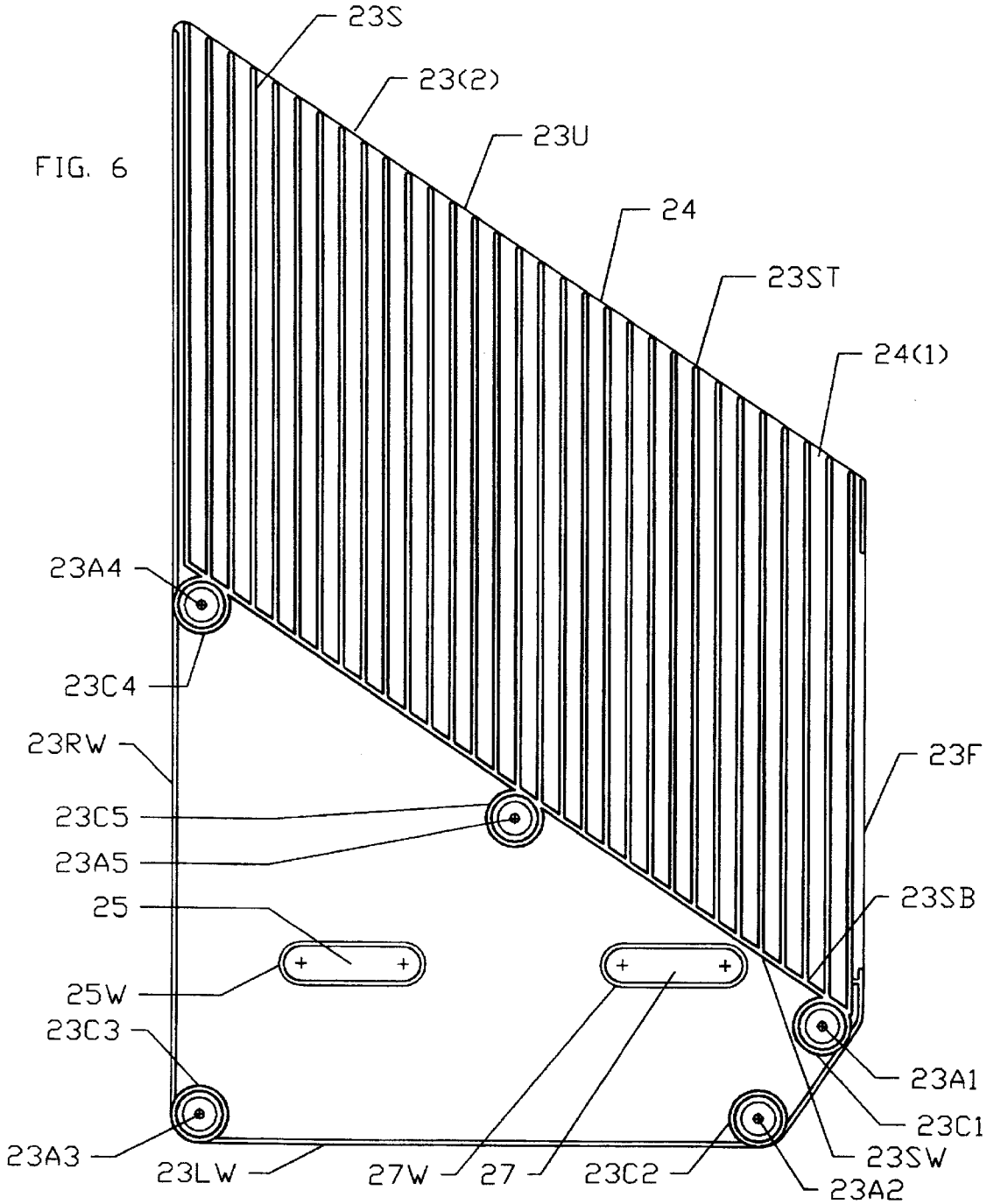
FIG. 6 is an inside view of the right side member of FIG. 1.
Figure 9:
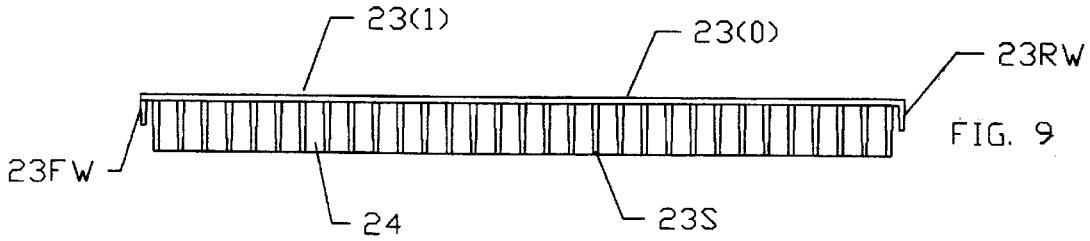
FIG. 9 is a top plan view of FIG. 8.
Figure 8:
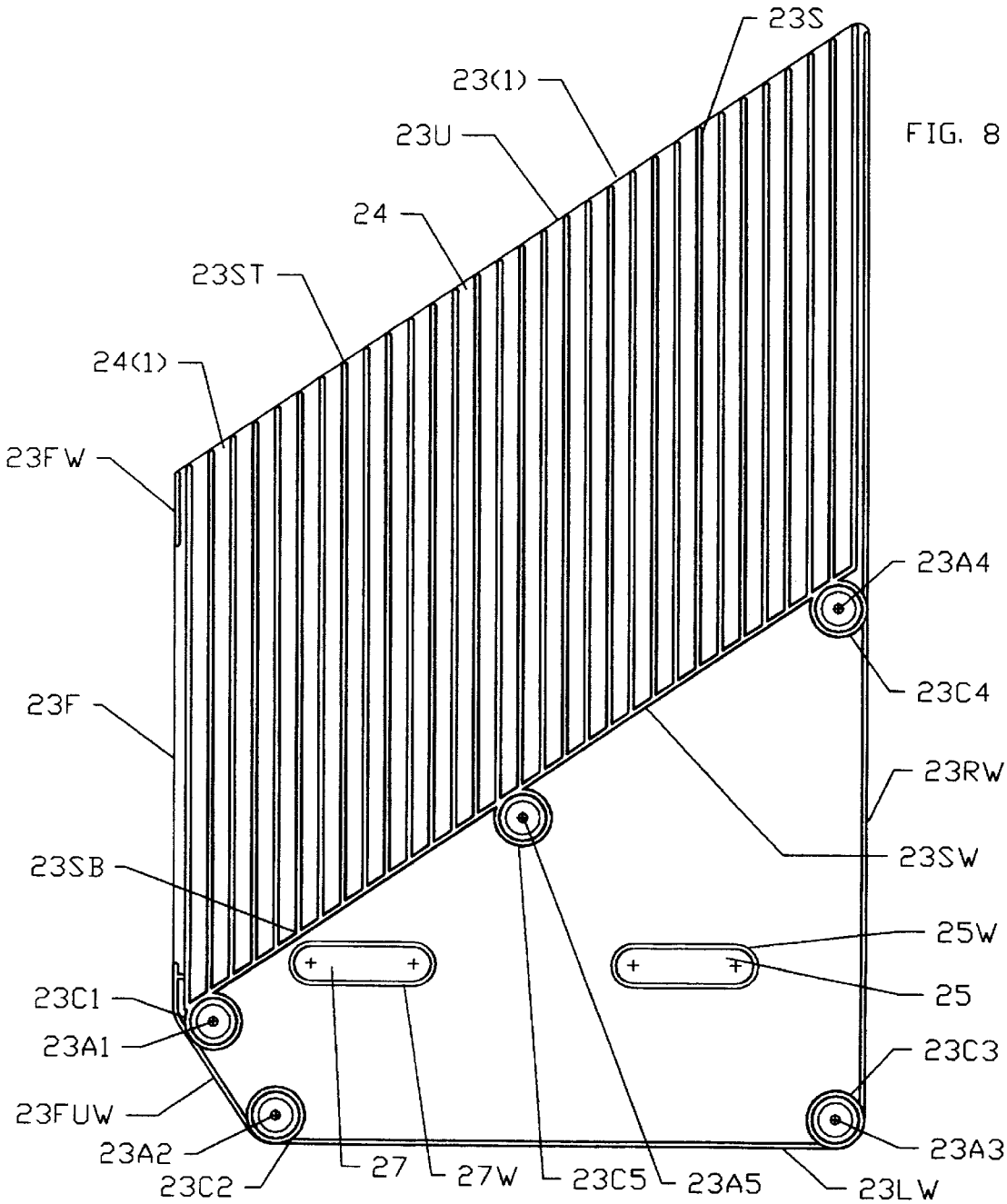
FIG. 8 is an inside view of the left side member of FIG. 1.
Figure 10:
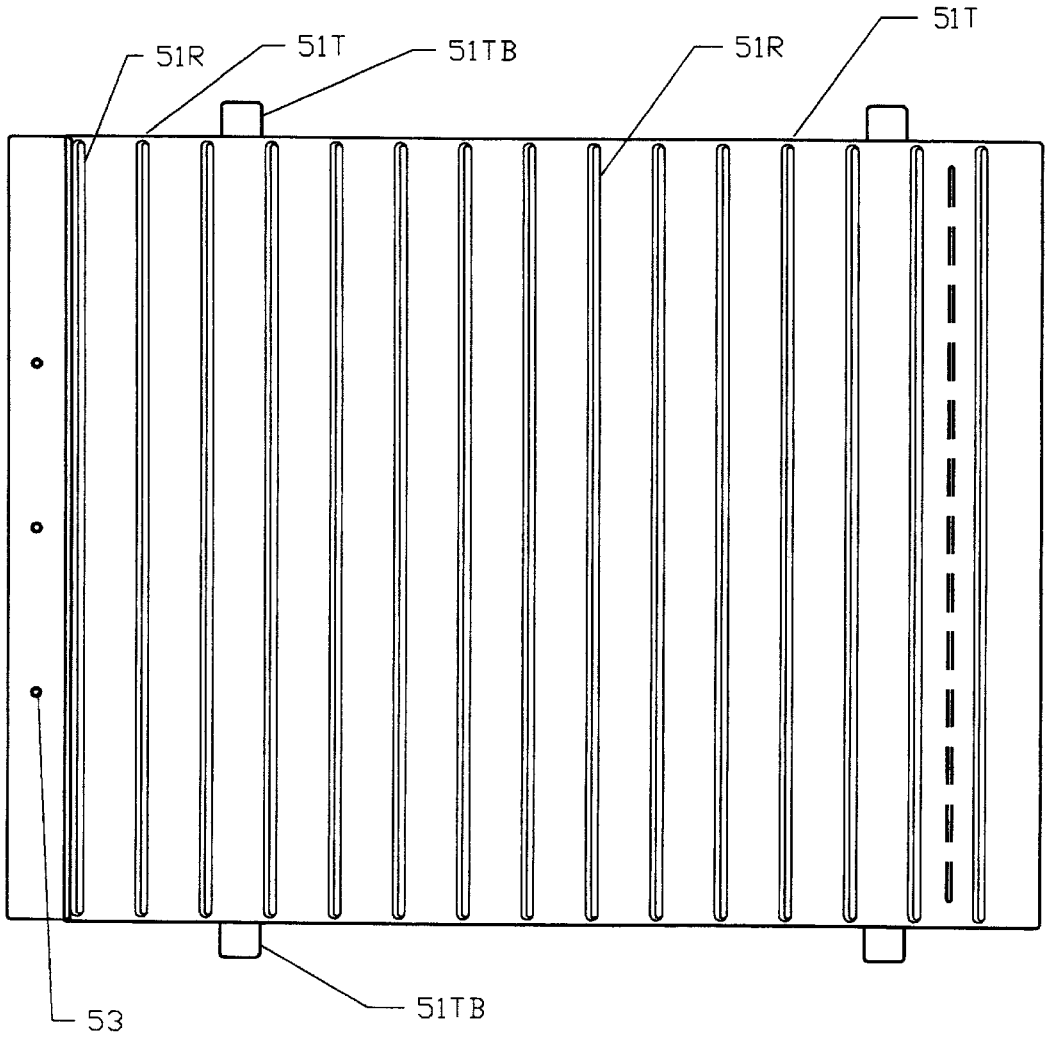
FIG. 10 is a top plan view of the top floor panel of FIGS. 1 and 2.
Figure 11:
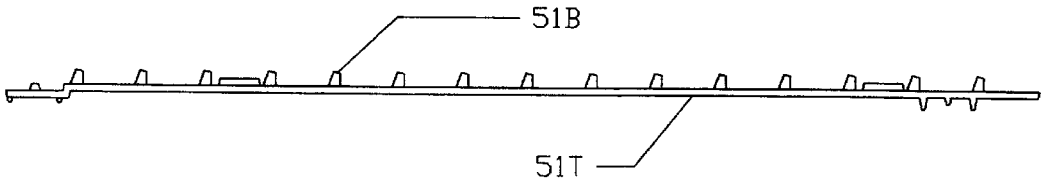
FIG. 11 is an edge view of the floor panel of FIG. 10.
Figure 12:
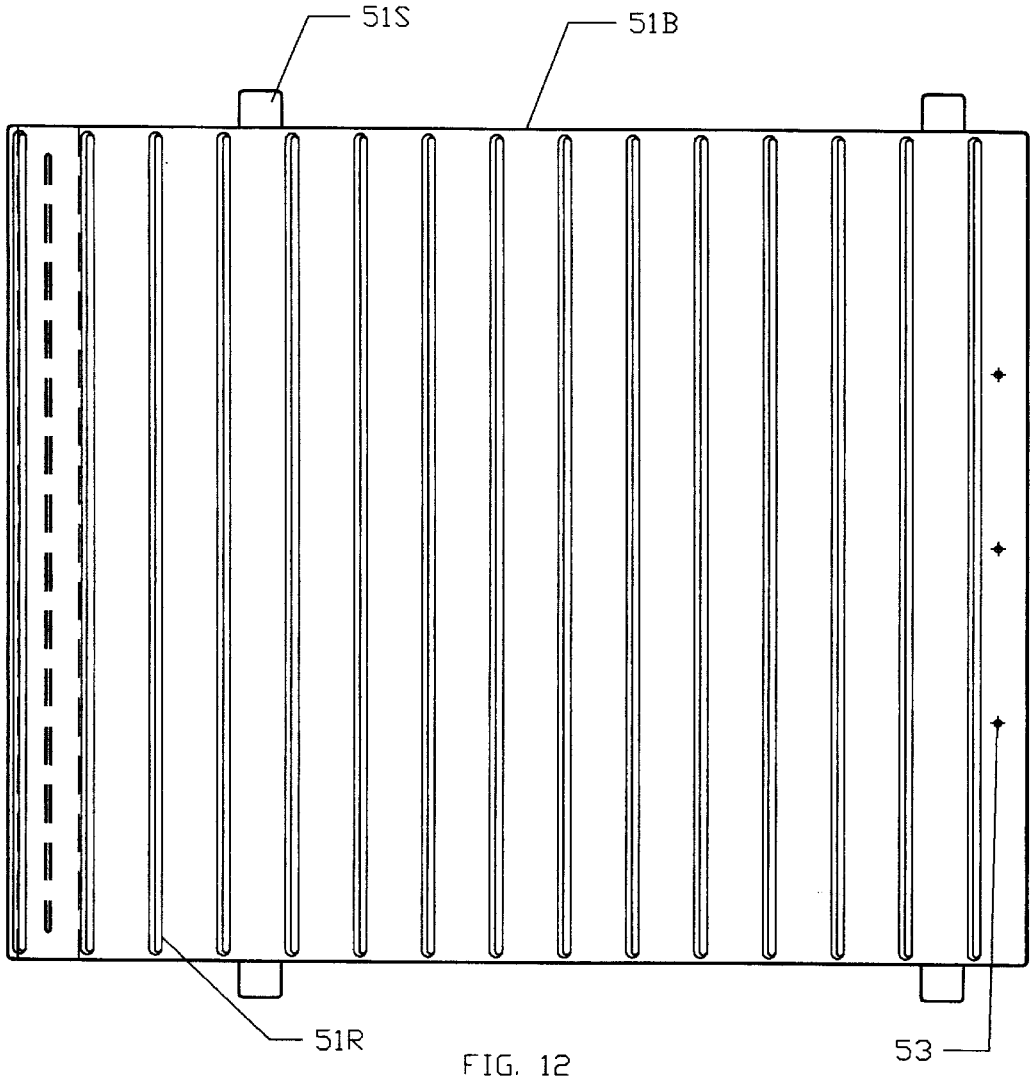
FIG. 12 is a top plan view of the bottom floor panel of FIGS. 1 and 2.
Figure 13:
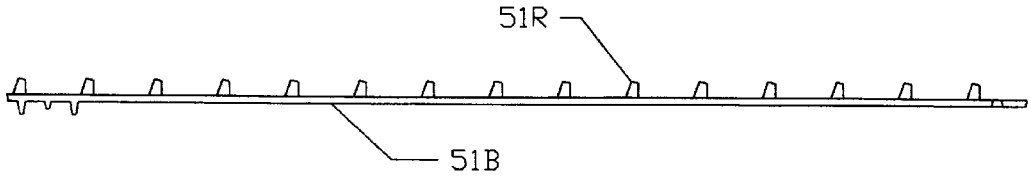
FIG. 13 is an edge view of the floor panel of FIG. 12.
Figure 14:
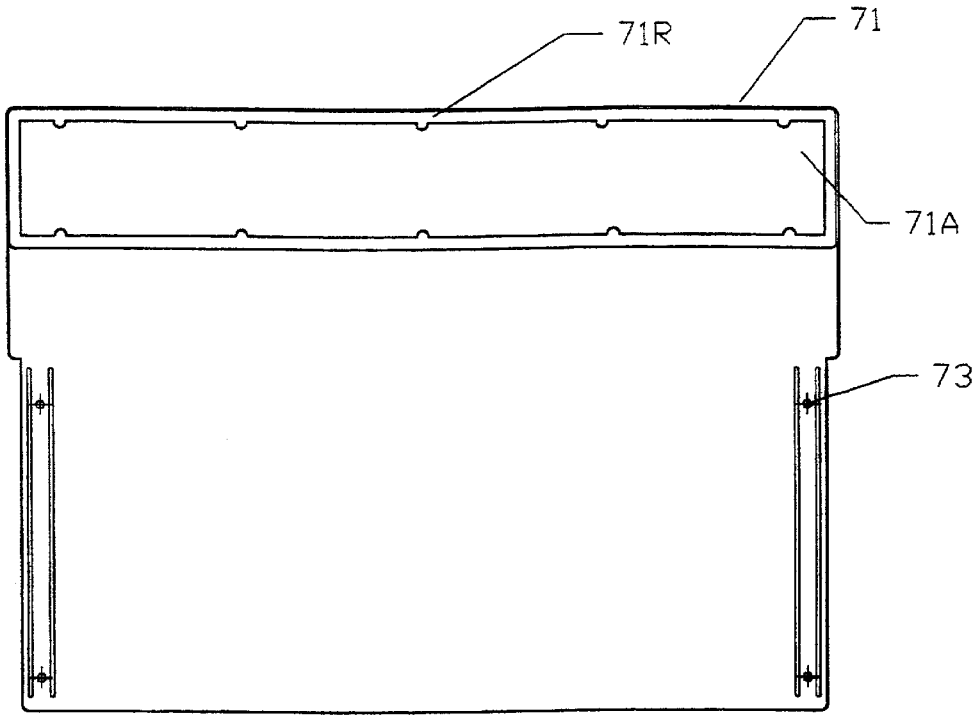
FIG. 14 is an enlarged view of the rear header of the holder.

Referring now to the drawings, the sample holder of the invention is identified at 21. It comprises two side members 23(1) and 23(2). The member 23(1) will be described in detail. Member 23(1) has an inside 23I and an outside 23(O); an upper edge 23U; a lower edge 23L; a front edge 23F; and a rear edge 23R. The front edge portion 23F and the rear edge 23R are parallel to each other and the lower edge 23L is perpendicular to the edges 23R and 23F. The edge portion 23FL forms an obtuse angle relative to edges 23F and 23L. The upper edge 23U slants upward and rearward from the top of edge 23F to the top of edge 23R. The angle Ø, as shown in FIG. 4, is equal to about 124 degrees and the angle $\alpha$ is equal to about 56 degrees. The outer side 23(O) is flat. Spaced apart parallel slats 23S are formed on the inside 23I of the wall 23(1). The slats extend upward parallel to the front and rear edges 23F and 23R. Adjacent slats 23S form a slot 24 therebetween. The side wall 23(1) including the slats 23S is injection molded as an integral member from structural foam plastic.

The side wall 23(1) has thin front and upper edges 23F and 23U with inward extending walls 23RW, 23LW, and 23FUW at its rear, bottom, and lower front edges 23FU, which are molded to the wall 23(1). The tops 23ST of the slats 23S follow the outline of the top edge 23U and the bottoms 23SB of the slats 23S are connected to an inward extending wall 23SW which is parallel to the top edge 23U and is molded to the wall 23(1). Also molded to the inside 23I of the wall are five sockets or hollow cylindrical members 23C1–21C5 which extend inward. Formed through the wall 23(1) inside of the sockets 23C1–23C5 are apertures or holes 23A1–23A5 respectively for receiving connecting bolts. Also formed through the wall 23(1) are two apertures 25 and 27 with surrounding inward extending walls 25W and 27W molded to the wall 23(1). Also molded to the wall 23(1) at its front edge 23F is an inward extending wall portion 23FW. The outside dimensions of side walls 23(1) and 23(2) are the same. The inside 23I and outside 23(0) of wall 23(2) are mirror images of the inside 23(1) and outside 23(0) of wall 23(1) respectively. The side wall 23(2) including the slats 23S also is injection molded as an integral member from structural foam plastic.

Figure 1:
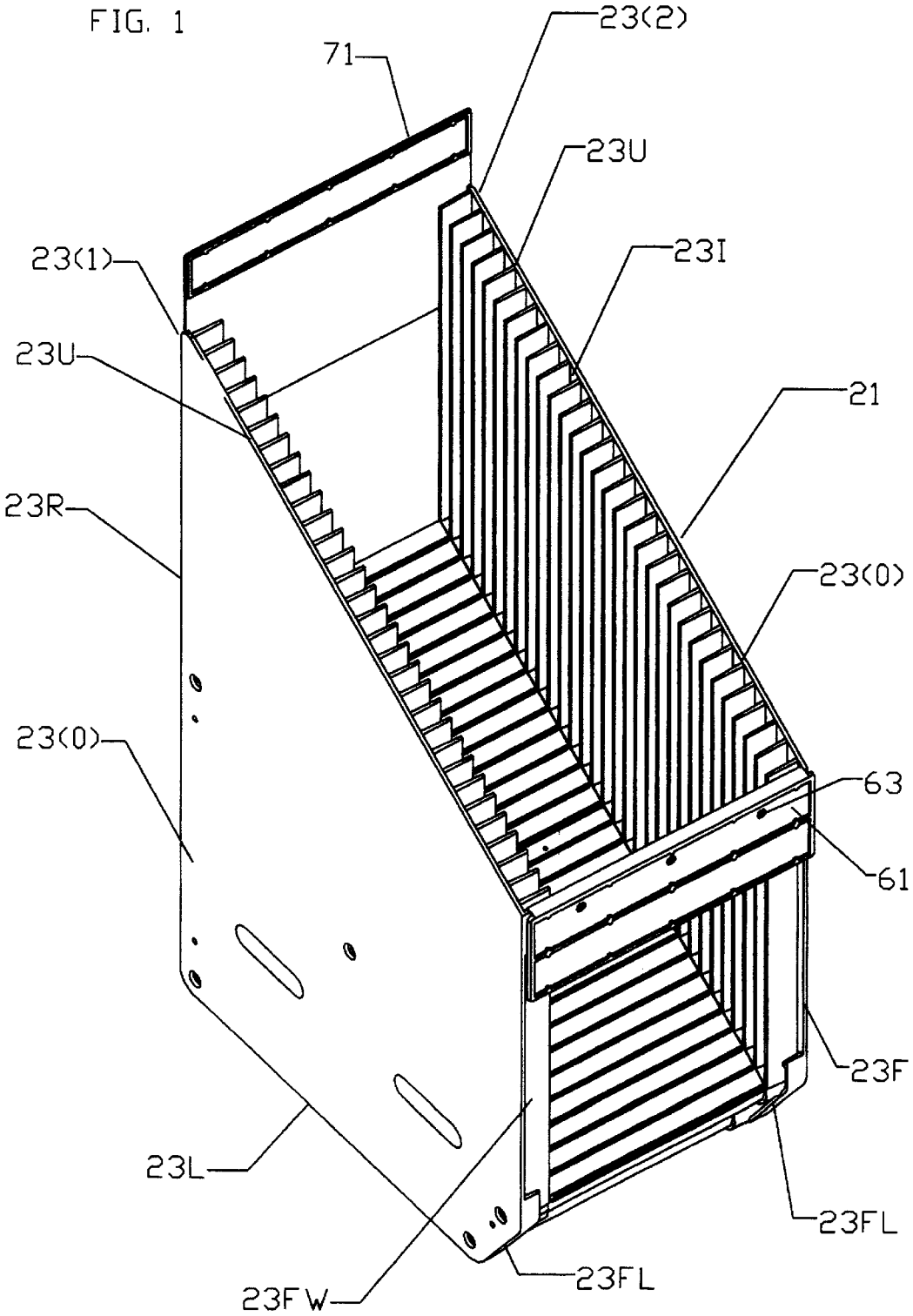
FIG. 1 is an isometric view of the assembled holder of the invention.
Figure 15:
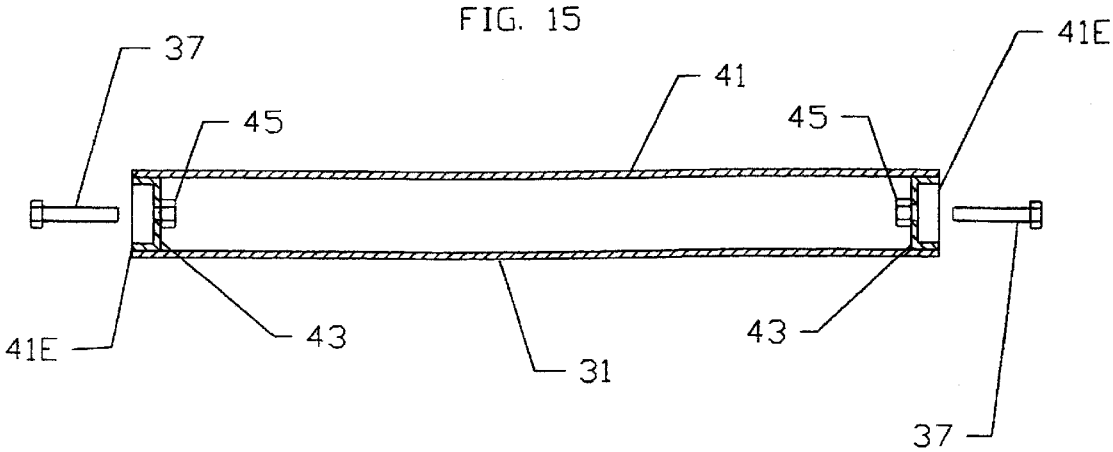
FIG. 15 is a cross-sectional view of one of the connecting tubes of the holder.

Five identical metal cylindrical members or tubes 31, 32, 33, 34, and 35 are employed to couple or connect the walls 23(1) and 23(2) together to form the assembled sample holder of FIG. 1. A cross-section of cylindrical member 31 is shown in FIG. 15. It comprises a hollow cylindrical wall 41 having two flanges 43 spaced inward from its ends 41E. Each flange 43 has an aperture formed therethrough and a nut 45 welded to the flange around the aperture.

The two side walls 23(1) and 23(2) are connected together by inserting the opposite ends of each of cylindrical members 31, 32, 33, 34 and 35 into the cylindrical sockets 23C1, 23C2, 23C3, 23C4, and 23C5 of the walls 23(1) and 23(2) and securing the side walls 23(1) and 23(2) to the cylindrical members by inserting bolts 37 through the holes 23A1, 23A2, 23A3, 23A4, and 23A5 of the walls 23(1) and 23(2) and screwing the bolts into the nuts 45. The cylindrical members 31–35 thus connect the walls 23(1) and 23(2) together at spaced apart positions to form a sample receiving space 47 between the walls 23(1) and 23(2).

When assembled, each slot 24 of wall 23(1) is aligned with a slot 24 of wall 23(2). For example, the first slot 24(1)

next to the edge 23F of wall 23(1) is aligned with the first slot 24(1) next to the edge 23F of wall 23(2) etc. such that a plurality of pairs of slots are formed for receiving a plurality of carpet samples each of which is a planar rectangular piece of carpet.

Figure 2:
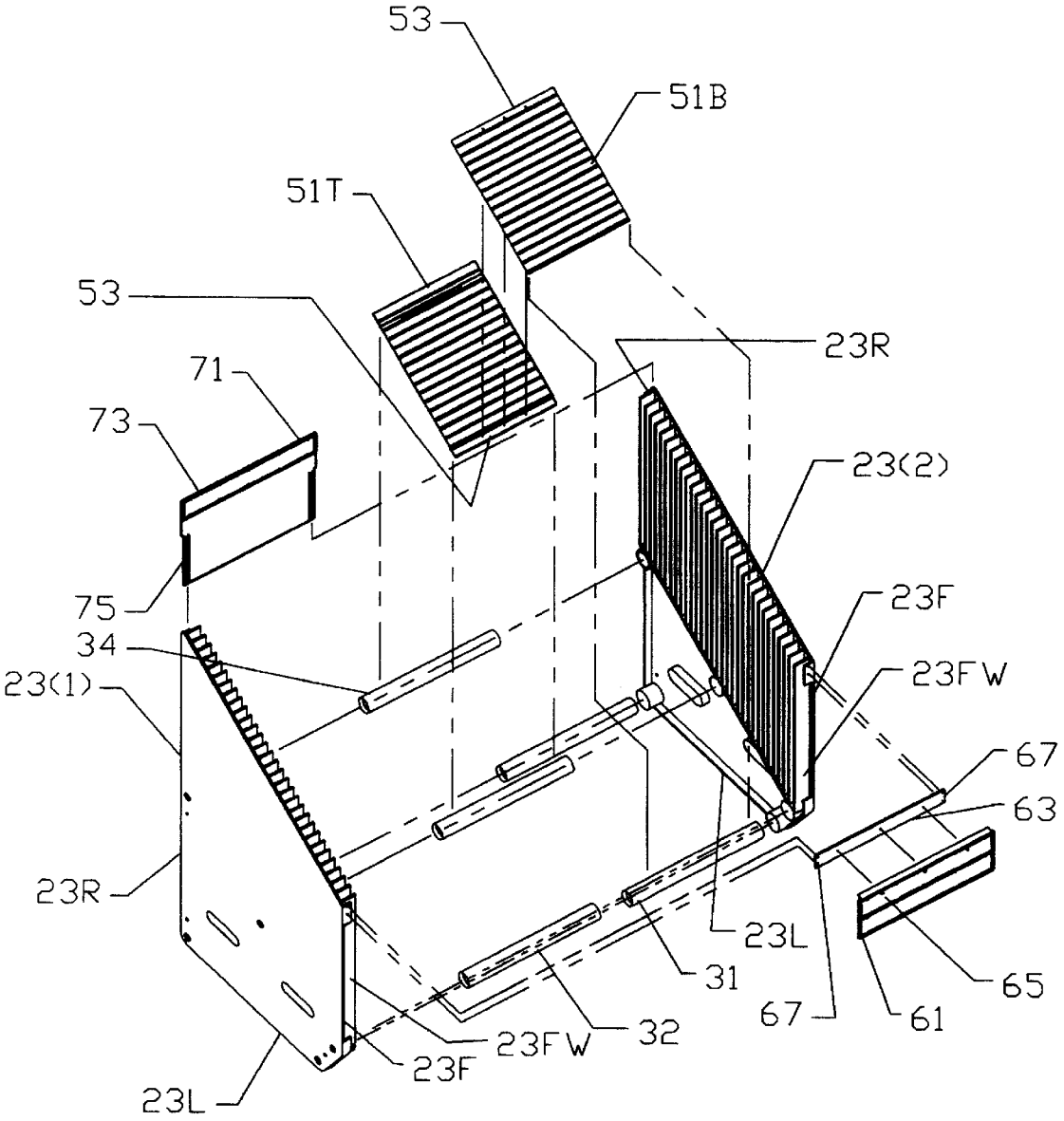
FIG. 2 is an exploded view of the holder of FIG. 1.
Figure 3:
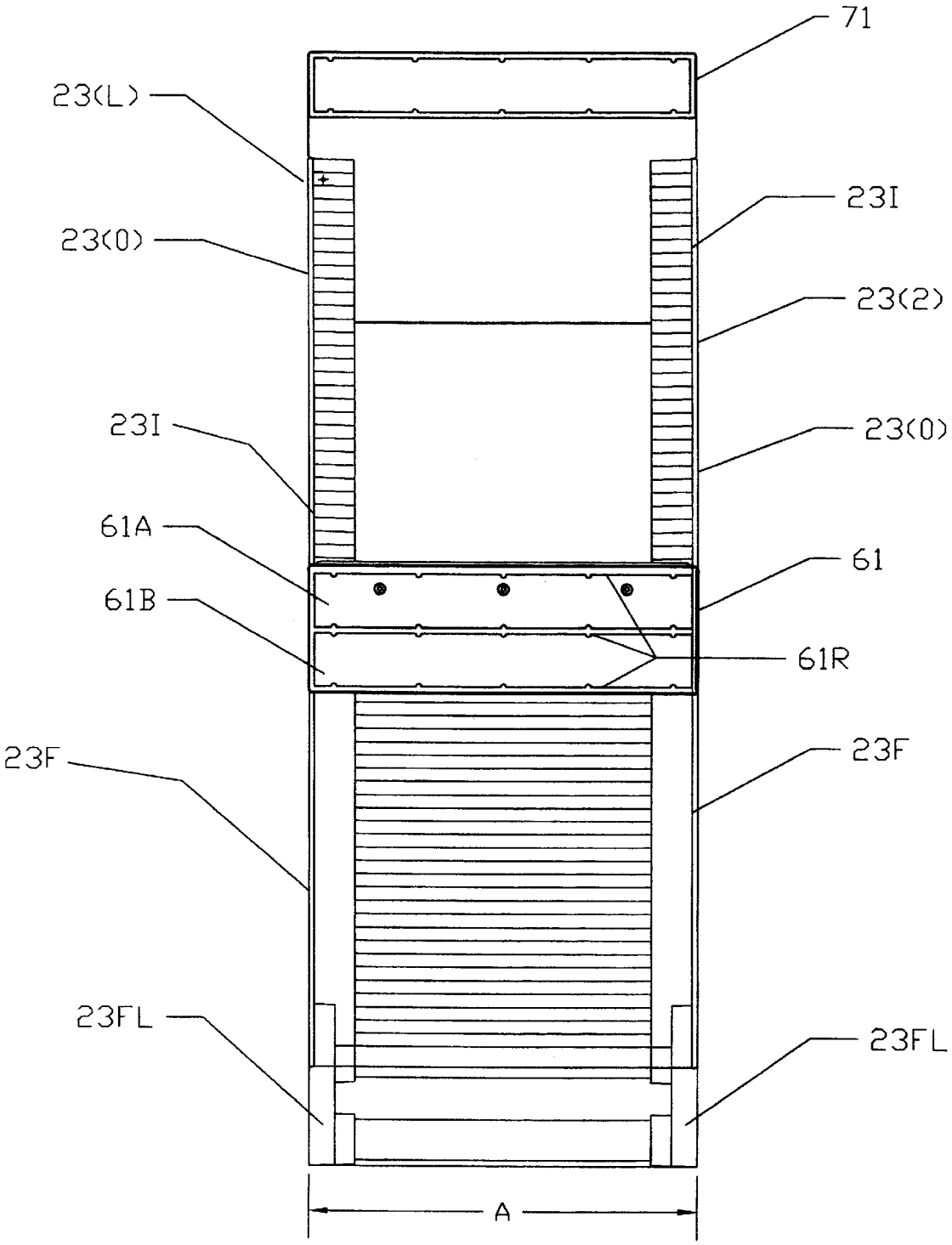
FIG. 3 is a front plan view of the holder of FIG. 1.

The bottoms of the carpet samples are supported by two floor members 51T and 51B which are supported by the cylindrical members 31, 35, and 34. Each floor member 51T and 51B comprises an injection molded plastic member having a plurality of spaced apart ridges 51R on their top sides with two spaced apart tabs 51TB extending outward from each side. The tabs are not shown in FIG. 2. The tabs fit in certain of slots 24 such that the lower end of each carpet sample will engage a ridge 51R and be supported by the floor member. After the two side members 23(1) and 23(2) are connected together by the cylindrical members 31–35, the two floor members 51T and 51B are coupled together with screws (not shown) screwed in holes 53 and located in place by sliding their tabs 51TB down the appropriate slots 24 until the upper floor 51T is supported by cylindrical members 34 and 35 and the lower floor 51B is supported by the cylindrical member 35 and 31.

Also provided are a front header 61 and a rear header 71 for supporting price cards or graphic illustrations. The header 61 is coupled to a steel cross bar plate 63 by screws 65 which in turn is coupled to wall members 23FW by screws 67. The header 61 comprises ridges 61R surrounding recessed portions 61A and 61B.

The rear header 71 is attached to the rear walls 23R with screws extending through apertures 73. The header has a ridge 71R which surrounds a recessed portion 71A.

In the preferred embodiment, dimensions A, B, and C may be equal to about 19 inches, 31 inches, and 55 5/16 inches respectively. The left and right side walls 23(1) and 23(2) may be injection molded from polyethylene. The floor panels 51 and headers may be formed of polystyrene. The 5 tubes 31–35 and the cross bar plate 63 may be formed of steel. The holder may have dimensions different from those indicated and the plastic material may be different from that indicated. Also it is to be understood that the holder may be used to hold flooring samples other than carpet samples.

What is claimed is:

1. An apparatus for holding carpet samples for display, comprising:

two side members, each of which comprises front and rear edges, a bottom edge, an upper edge, an inner side, and an outer side, said upper edge of each of said side members extends rearward and upward from an upper portion of its said front edge to an upper portion of its said rear edge, each of said inner sides comprising a plurality of spaced apart upright slats located between its said front and rear edges with adjacent slats forming a slot therebetween and with each of said slats having a top edge and a bottom edge, each of said slats rearward of an adjacent slat having its top and bottom edges located at a level above said top and bottom edges respectively of said adjacent slat, each of said side members and its said slats comprises an integral member molded from plastic material, means for supporting said two side members with their said slats facing each other and being spaced from each other to form a carpet sample receiving space, a floor coupled between said two side members at said bottom edges of said slats of said two side members such that said floor extends rearward and upward from said front edges toward said rear edges, each slot of one side member being aligned with a separate slot of the other side member to form a plurality of pairs of slots with each pair of slots and said floor being adapted to support a carpet sample, each pair of said slots and the space between each pair of said slots above said floor being free of support structure such that each carpet sample will be supported only by said floor and said slats forming each pair of said slots, said floor is formed of plastic material and comprises an upper side having a plurality of spaced apart ridges each for engaging an edge of a carpet sample, and a plurality of sockets molded to each side member on its said inner side below its said slats for receiving a plurality of connecting members for connecting said two side members together and for supporting said floor.

2. An apparatus for holding carpet samples for display, comprising:

two side members, each of which comprises front and rear edges, a bottom edge, an upper edge, an inner side, and an outer side, said upper edge of each of said side members extends rearward and upward from an upper portion of its said front edge to an upper portion of its said rear edge, each of said inner sides comprising a plurality of spaced apart upright slats located between its said front and rear edges with adjacent slats forming a slot therebetween and with each of said slats having a top edge and a bottom edge, each of said slats rearward of an adjacent slat having its top and bottom edges located at a level above said top and bottom edges respectively of said adjacent slat, each of said side members and its said slats comprises an integral member molded from plastic material, means for supporting said two side members with their said slats facing each other and being spaced from each other to form a carpet sample receiving space, a floor coupled between said two side members at said bottom edges of said slats of said two side members such that said floor extends rearward and upward from said front edges toward said rear edges, each slot of one side member being aligned with a separate slot of the other side member to form a plurality of pairs of slots with each pair of slots and said floor being adapted to support a carpet sample, each pair of said slots and the space between each pair of said slots above said floor being free of support structure such that each carpet sample will be supported only by said floor and said slats forming each pair of said slots, and a plurality of sockets molded to each side member on its said inner side below its said slats for receiving a plurality of connecting members for connecting said two side members together and for supporting said floor.

3. The apparatus of claim 2, comprising:

handling slots formed through each of said side members between said front and rear edges and below said slats thereof.

4. The apparatus of claim 2, wherein:

said sockets of each of said side members are located near said front and rear edges, near said bottom edges of each of said side members, and at a position intermediate said front and rear edges below said slats thereof.

5. The apparatus of claim 4, comprising:

handling slots formed through each of said side members between said front and rear edges and below said slats thereof.

6. An apparatus for holding flooring samples, comprising:

two side members, each of which comprises front and rear edges, a bottom edge, an upper edge, an inner side, and an outer side, said upper edge of each of said side members extends rearward and upward from an upper portion of its said front edge to an upper portion of its said rear edge, each of said inner sides comprising a plurality of spaced apart upright slats located between its said front and rear edges with adjacent slats forming a slot therebetween and with each of said slats having a top edge and a bottom edge, each of said slats rearward of an adjacent slat having its top and bottom edges located at a level above said top and bottom edges respectively of said adjacent slat, means for supporting said two side members with their said slats facing each other and being spaced from each other to form a flooring sample receiving space, a floor coupled between said two side members at said bottom edges of said slots of said two side members, each slot of one side member being aligned with a separate slot of the other side member to form a plurality of pairs of slots with each pair of slats and said floor being adapted to support a flooring sample, each of said side members and its slats comprise an integral member molded from plastic material, and a plurality of sockets molded to each side member on its said inner side below its said slats for receiving a plurality of connecting members for connecting said two side members together and for supporting said floor.

7. The apparatus of claim 6, comprising:

handling slots formed through each of said side members between said front and rear edges and below said slats thereof.

8. The apparatus of claim 6, wherein:

said sockets of each of side members are located near said front and rear edges, near said bottom edges of each of said side members, and at a position intermediate said front and rear edges below said slats thereof.

9. The apparatus of claim 8, comprising:

handling slots formed through each of said side members between said front and rear edges and below said slats thereof.

* * * * *